US006311771B1

(12) United States Patent
Gudmestad et al.

(10) Patent No.: US 6,311,771 B1
(45) Date of Patent: Nov. 6, 2001

(54) PLUG FOR USE IN WELLBORE OPERATIONS AND APPARATUS FOR LAUNCHING SAID PLUG

(75) Inventors: Tarald Gudmestad, Naerbo (NO); Frederick Thomas Tilton, Spring, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/530,855

(22) PCT Filed: Nov. 4, 1998

(86) PCT No.: PCT/GB98/03280

§ 371 Date: Jul. 31, 2000

§ 102(e) Date: Jul. 31, 2000

(87) PCT Pub. No.: WO99/24692

PCT Pub. Date: May 20, 1999

(30) Foreign Application Priority Data

Nov. 7, 1997 (GB) ..... 9723581

(51) Int. Cl.[7] ..... E21B 33/05; E21B 33/16

(52) U.S. Cl. ..... 166/154; 166/153; 166/155; 166/179; 166/193

(58) Field of Search ..... 166/153, 154, 166/155, 177.4, 179, 192, 193, 291; 15/104.061

(56) References Cited

U.S. PATENT DOCUMENTS

| | | | | |
|---|---|---|---|---|
| 1,527,749 | * | 2/1925 | Raymond | 166/153 |
| 1,772,871 | * | 8/1930 | MacClatchie | 166/153 X |
| 2,560,901 | * | 7/1951 | Smith | 166/155 |
| 2,907,392 | * | 10/1959 | Ormsby | 166/155 X |
| 4,164,980 | | 8/1979 | Duke | 166/291 |
| 4,624,312 | * | 11/1986 | McMullin | 166/155 |
| 5,242,018 | * | 9/1993 | LaFleur | 166/155 |
| 5,433,270 | * | 7/1995 | LaFleur | 166/153 X |
| 5,762,139 | * | 6/1998 | Sullaway et al. | 166/291 |

FOREIGN PATENT DOCUMENTS

| | | |
|---|---|---|
| 2 641 319 | 6/1990 | (FR) . |
| WO 94/27026 | 11/1994 | (WO) . |

* cited by examiner

*Primary Examiner*—George Suchfield
(74) *Attorney, Agent, or Firm*—Moser, Patterson & Sheridan, L.L.P.

(57) ABSTRACT

An apparatus for launching at least two plugs, said apparatus comprising a mandrel (2), a lower plug (22) and an upper plug (21) releasably disposed with respect to said mandrel (2), wherein said upper plug (21) comprises a body (23) having a flow path (24) therethrough and a cap (25) for blocking fluid flow through said flow path (24) characterized in that said cap (25) is detachable from said body (23) in use if the upper plug (21) is prematurely ejected.

14 Claims, 6 Drawing Sheets

PLUG FOR USE IN WELLBORE OPERATIONS AND APPARATUS FOR LAUNCHING SAID PLUG

STATEMENT REGARDING FEDERALLY SPONSORED RESEARCH OR DEVELOPMENT

Not Applicable

REFERENCE TO A MICROFICHE APPENDIX

Not Applicable

CROSS-REFERENCE TO RELATED APPLICATIONS

This application claims benefit of Great Britain application number 9723581.6, filed Nov. 7, 1997, which is herein incorporated by reference.

BACKGROUND OF THE INVENTION

1. Field of the Invention

This invention relates to a plug for use in wellbore operations and an apparatus for launching said plug.

2. Description of the Related Art

During the construction of an oil or gas well a hole is bored in the ground. A string of casing is lowered down the hole and the annular space between the casing and the wellbore filled with cement.

In order to inhibit the cement mixing freely with other wellbore fluids it is normal to use two devices which are referred to as "cementing plugs". When it is desired to cement the casing in place a first (bottom) cementing plug is released into the casing. The cement is then pumped into the casing and pushes the bottom plug downwardly. When the desired volume of cement has been introduced into the casing a top plug is introduced into the casing and pumped downwardly by a convenient fluid, typically sea water or circulating fluid. The cement then travels down the casing trapped between the bottom and top plugs. When the bottom plug reaches the bottom of the casing it lands on a one way valve known as a float collar. Pressure is applied to the top plug until a bursting disk in the bottom plug ruptures and allows the cement to be pushed through a flow bore in the bottom plug, through the float collar and upwardly into the annular space between the casing and the bore. The description thus far relates to normal operation. However, occasionally the bottom plug and the top plug are released simultaneously with the result that a large column of cement is pumped down the casing on top of the top plug. Since the top plug is designed to withstand high pressures it will not rupture and consequently the cement sets and has to be drilled out.

A large number of devices have been designed for preventing inadvertent simultaneous release of the bottom plug and top plugs and those which have been designed for use at the surface of a land well are generally satisfactory. However, the problem which does remain is when a casing is extended by a liner and it is necessary to cement the liner in position. In this case the bottom and top plugs have to be released remotely from the surface. Although there are a number of apparatus intended for inhibiting simultaneously release of the top and bottom plugs in these circumstances it is still not unknown for the plugs to be released simultaneously with expensive consequences.

SUMMARY OF THE INVENTION

The present invention approaches this problem from an entirely new angle and, whilst it is primarily intended for use with liner hanging and drilling equipment, can also be used at the surface.

According to the present invention there is provided a plug for use in wellbore operations, which plug comprises a body having a flow path therethrough and a cap for blocking flow of fluid through said flow path, characterized in that said cap is detachable from said body in use.

The present invention should not be confused with plugs of the type having hinged caps which are not detachable from the body in use.

Preferably, said plug further comprises a restraining device attached to said cap.

Advantageously, said restraining device comprises a flexible belt.

Preferably, said plug further comprises a sealing ring to provide a substantially fluid tight seal between said cap and said body of said plug.

Advantageously, said plug comprises elastomeric material.

Preferably, said cap is attached to said body by fingers.

The present invention also provides an apparatus for launching at least two plugs, said apparatus comprising a mandrel, a lower plug and an upper plug releasably disposed with respect to said mandrel, wherein said upper plug comprises a body having a flow path therethrough and a cap for blocking fluid flow through said path characterized in that said cap is detachable from said body in use.

Preferably, said apparatus further comprises a restraining device attached to said cap and to said mandrel.

Advantageously, said restraining device comprises a flexible belt.

Preferably, said restraining device is attached to said mandrel via a shear pin.

Advantageously, said shear pin is adapted to be sheared after completion of an operation intended to release said upper plug.

Preferably, said operation is landing of a dart intended to initiate release of said upper plug.

Advantageously, said apparatus further comprises a sealing ring to provide a substantially fluid tight seal between said cap and said body of said plug.

Preferably, said cap is attached to said body by fingers.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1A:
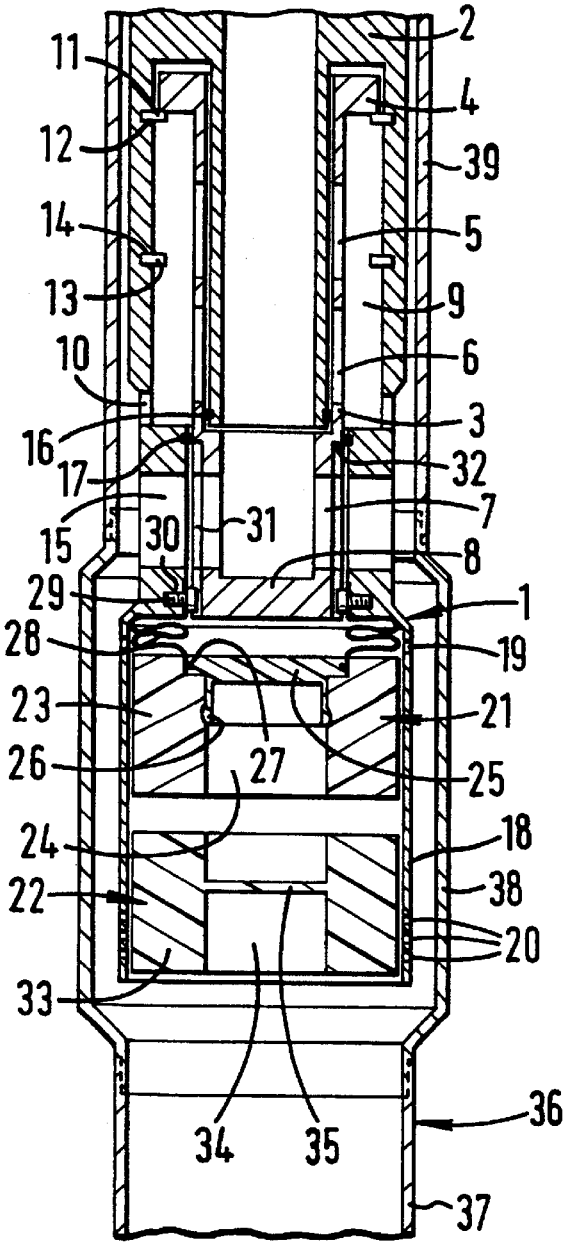
FIGS. 1*a* to 1*g* show a cross-section of an apparatus in accordance with the invention in use in various stages of normal operation.

Referring to the drawings there is shown a plug launching apparatus which is generally identified by reference numeral 1. The plug launching apparatus 1 comprises a hollow mandrel 2 which is connected at its upper end to the lower end of a liner setting tool (not shown). The plug launching apparatus 1 incorporates a displacement member 3.

The displacement member 3 comprises a lip 4, an upper row of displacement member ports 5, a middle row of displacement member ports 6 and a lower row of displacement member ports 7, each row being disposed circumferentially thereabout. The displacement member 3 also comprises a seat 8.

There is provided an annular space 9 in the hollow mandrel 2 which accommodates the displacement member 3. A first row of mandrel ports 10 is disposed circumferentially about the hollow mandrel 2 and allows fluid communication between the annular space 9 and the exterior of the plug launching apparatus 1. Upper shear pins 11 are retained in recesses 12 in the hollow mandrel 2 and inhibit the displacement member 3 from longitudinal movement therein. Lower shear pins 13 are retained in recesses 14 in the hollow mandrel 2. A second row of mandrel ports 15 is disposed circumferentially about hollow mandrel 2 and is initially in line with the lower row of displacement member ports 7.

Upper sealing ring 16 and lower sealing ring 17 act as a fluid tight seal between hollow mandrel 2 and the displacement member 3. It should be noted the lip 4 does not sealingly engage the hollow mandrel 2 and there are provided small gaps therebetween through which fluid may flow.

A plug container 18 is disposed below the hollow mandrel 2 and is integral or otherwise connected thereto. A row of small diameter container ports 19 is disposed at the top and circumferentially around the plug container 18. A set of container ports 20 are disposed at the bottom of and circumferentially around the plug container 18 in three rows.

In use, the plug container is loaded with an upper plug 21 and a lower plug 22. The upper plug 21 comprises an elastomeric body 23 which has external fins (not shown) arranged circumferentially thereabout. The elastomeric body 23 is provided with a generally concentric flow path 24. The flow path 24 is initially blocked by a cap 25 which is locked in place by fingers 26. The cap 25 is provided with a sealing ring 27 to provide a substantially fluid tight seal between the cap 25 and the elastomeric body 23. Flexible belts 28 are attached to the cap 25 at one end, and to a shear bolt 29 at the other. The shear bolt 29 is located in a shear bolt recess 30 in the hollow mandrel 2, and projects into a recess 31 between the hollow mandrel 2 and the displacement member 3 and below a shoulder 32 thereon.

The lower plug 22 comprises an elastomeric body 33 which also has external fins (not shown) arranged circumferentially thereabout. The elastomeric body 33 is provided with a generally concentric flow path 34. The flow path 34 is initially blocked by a bursting disk 35.

The plug launching apparatus 1 is then loaded into a liner assembly generally referred to by reference numeral 36. The liner assembly 36 comprises a liner 37, a coupling 38 and a liner hanger unit 39.

The plug container 18 is aligned with the coupling 38 in order that an annulus is formed between the plug container 18 and the coupling 38. The coupling 38 is screwed or otherwise attached to the top of the liner 37. A liner hanger unit 39 (only part of which is shown) is screwed or otherwise attached to the top of the coupling 38.

The top of the liner hanger unit 39 is attached to a tool string (not shown). The liner assembly 36 is lowered into the cased wellbore (not shown) to the lower end thereof. The liner is hung on the lower end of the casing using the liner hanger unit 39 which is typically activated mechanically or hydraulically. Initially fluid is allowed to flow through the hollow mandrel 2 and out into the liner 37 through displacement member ports 7 which are aligned with mandrel ports 15.

Figure 1B:
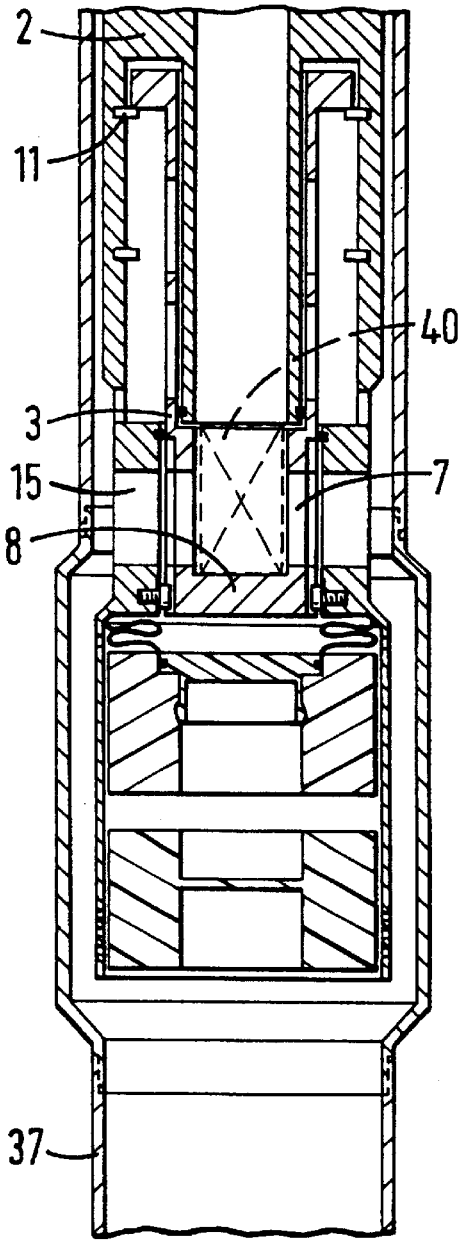

The liner 37 can now be cemented in place. To effect this operation a first dart 40 (FIG. 1*b*) is pumped down the tool string and through the hollow mandrel 2 using cement. The first dart 40 lands on seat 8 of displacement member 3 and substantially blocks the lower displacement member ports 7 and hence the second row of mandrel ports 15.

Figure 1C:
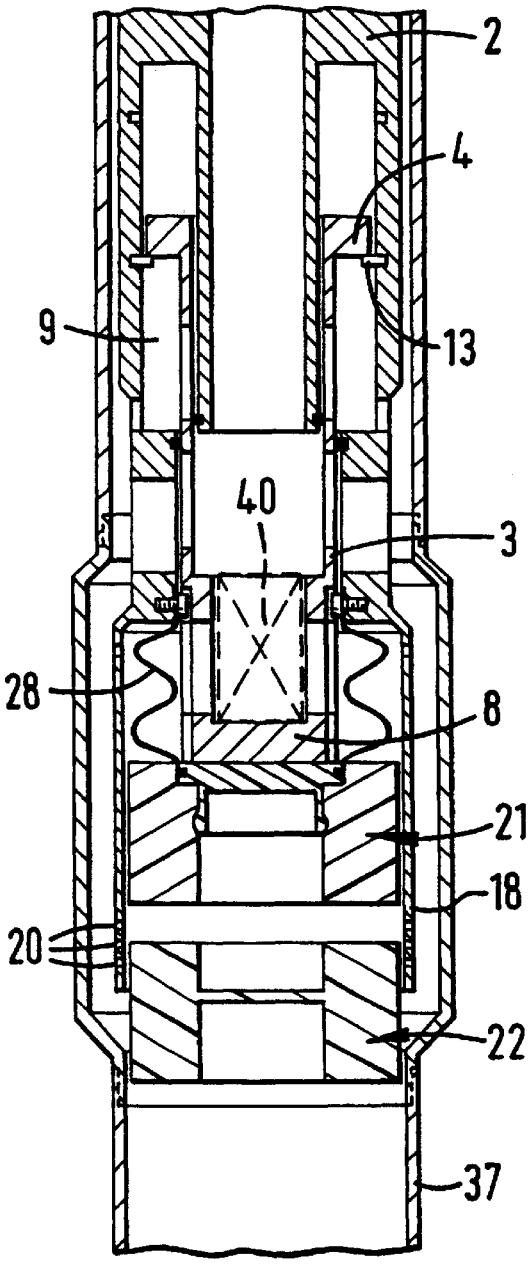
Figure 1D:
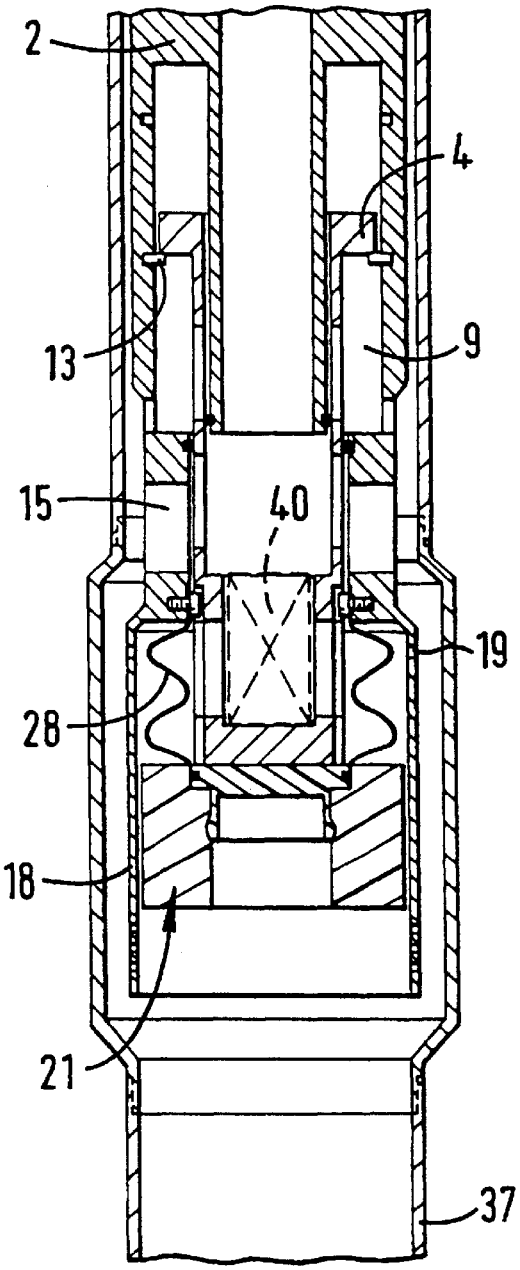

Pressure builds up in the hollow mandrel 2 and forces displacement member 3 downwardly shearing the upper shear pins 11 (FIG. 1C). The fluid in the annular space 9 flows through the small gap between the lip 4 and the hollow mandrel 2. The pressure differential across the lip 4 acts as a damper and helps prevent impact on the lower shear pins 13. The lower plug 22 is ejected from the plug container 18 by the seat 8 of the displacement member 3. Middle displacement member ports 6 now align with the second row of mandrel ports 15 and allow cement to flow from the hollow mandrel 2 into the annulus formed by the plug container 18 and into liner 37 hence pushing the lower plug 22 down therethrough ahead of the cement (FIG. 1*d*). The flexible belts 28 extend, however there is provided enough slack in the belts so that full extension of the flexible belts 28 is not reached. A row of small diameter container ports 19 are provided to aid damping i.e. as the upper plug 21 moves downwardly the displaced volume slowly fills with cement through the small diameter container ports 19.

The set of container ports 20 aids separation of the plugs by allowing cement to flow into the plug container 18 before the lower plug 22 has completely ejected the plug container 18.

Figure 1E:
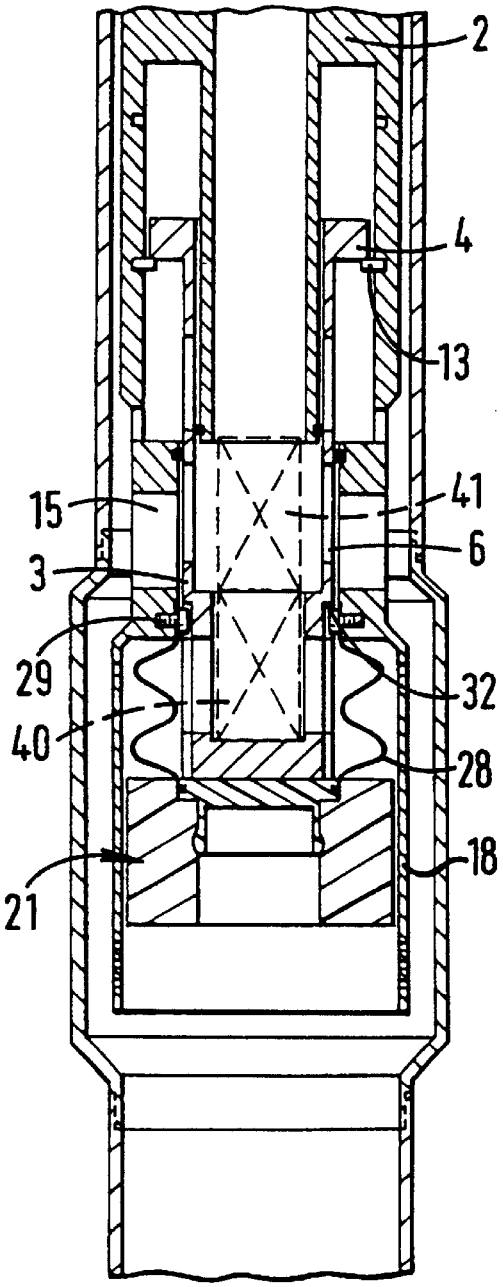
Figure 1F:
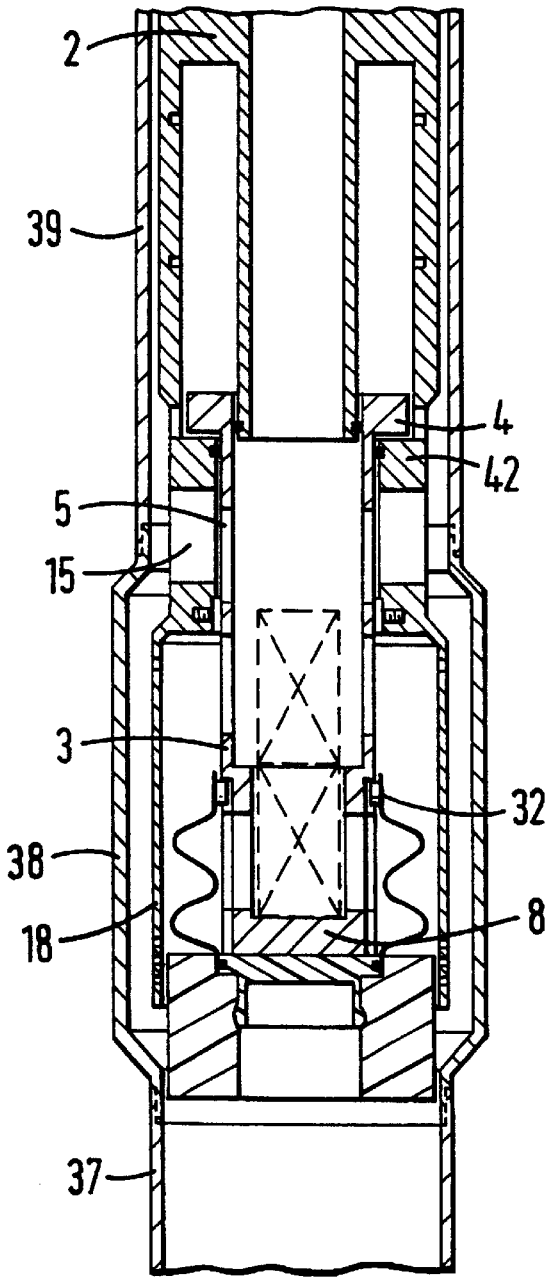
Figure 1G:
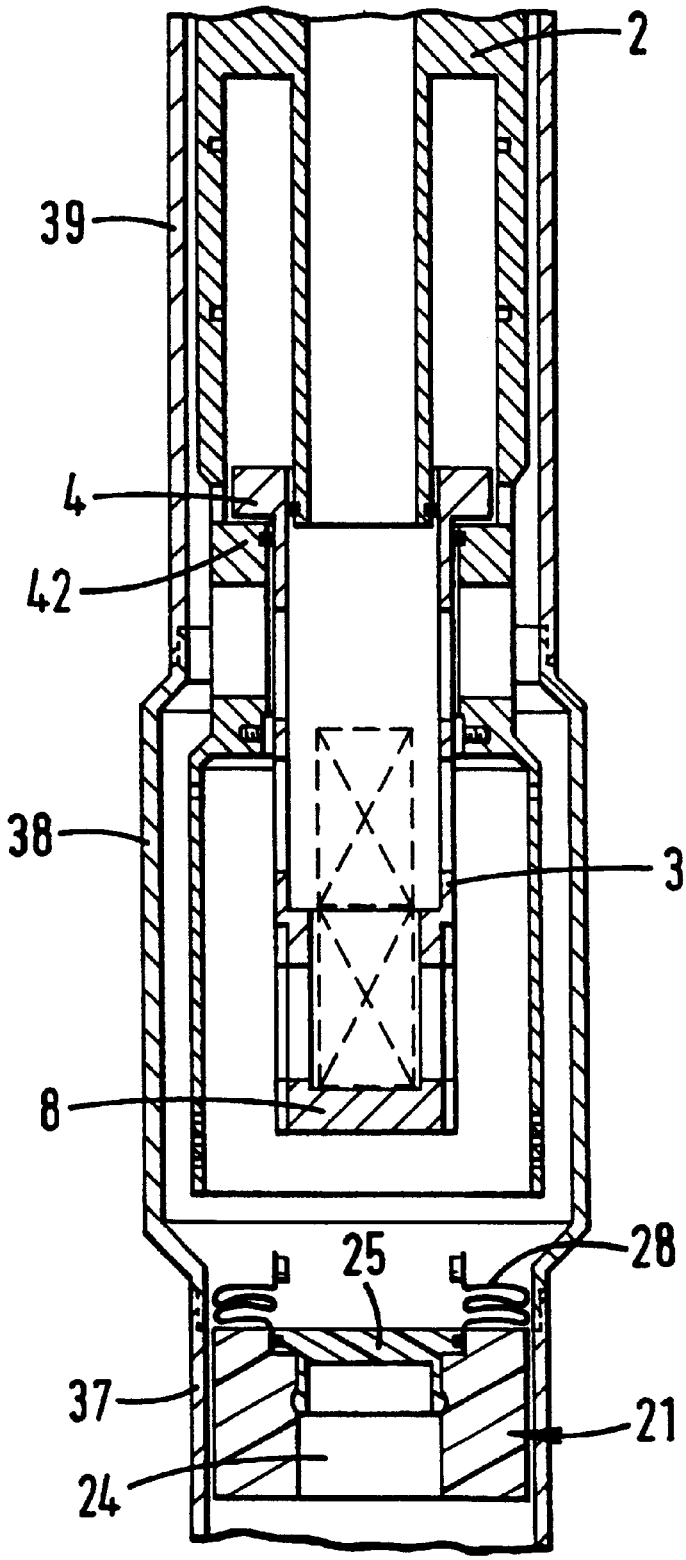

After a predetermined quantity of cement has been pumped down the tool string a second dart 41 is pumped down the tool string and through hollow mandrel 2 using mud, water or any other suitable fluid. The second dart 41 lands on first dart 40 and substantially blocks the middle displacement member ports 6 and hence mandrel ports 15 (FIG. 1*e*). Pressure builds up in the hollow mandrel 2 and forces displacement member 3 downwardly shearing the lower shear pins 13. Substantially simultaneously, the shoulder 32 shears shear bolt 29 which releases the flexible belts 28. Fluid flows through the small gap between the lip 4 and the hollow mandrel 2. Again, the change in pressure differential across the lip 4 acts as a damper. The upper plug 21 is ejected from the plug container 18 by the seat 8 of the displacement member 3 with the cap 25 remaining attached to the upper plug 21 blocking the flow path 24, together with the flexible belts 28.

The lip 4 meeting shoulder 42 of the hollow mandrel 2 prevents displacement member 3 from further downward movement. Upper displacement member ports 5 are now aligned with the second row of mandrel ports 15 and allow fluid to flow from the hollow mandrel 2 into liner 37 hence pushing the upper plug 21 down therethrough behind the cement.

It should be noted that the internal diameter of the liner hanger unit 39 is slightly larger than the internal diameter of the liner 37 so that the plug container 18 may be raised in relation to the liner hanger unit 39 without the need for collapse of the plug container 18. However, if the external diameter of the plug container 18 is greater than the internal diameter of the liner hanger unit 39, the plug container 18 may be allowed to collapse on lifting therethrough.

Figure 2A:
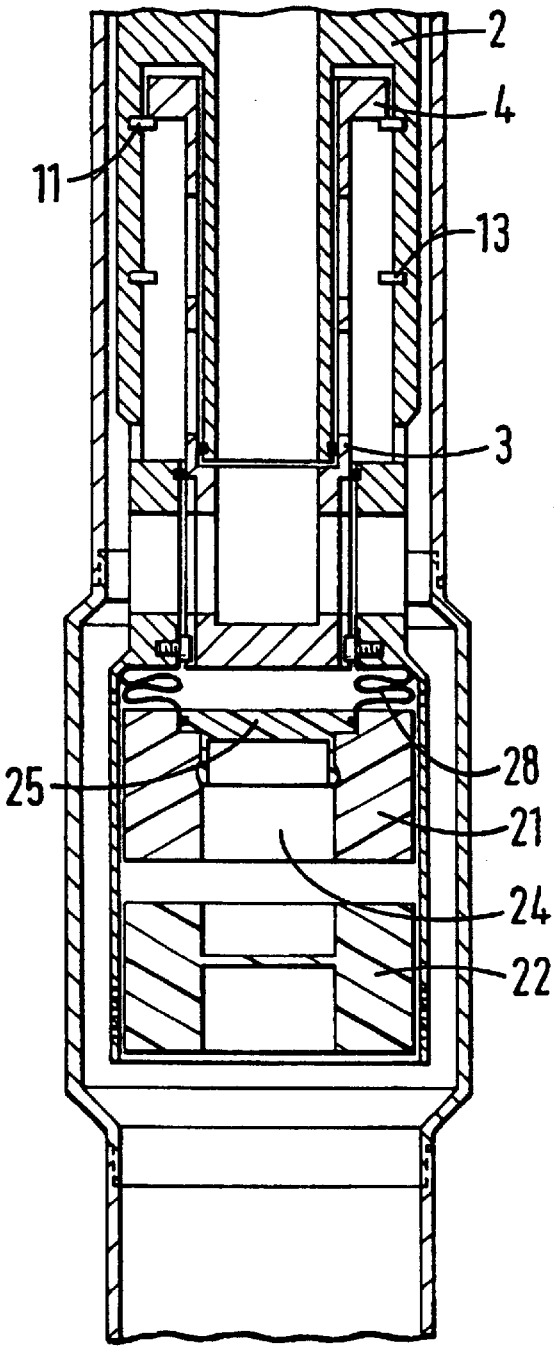
FIGS. 2*a* to 2*d* show a cross-section of the apparatus of FIG. 1 in various stages of abnormal operation.
Figure 2B:
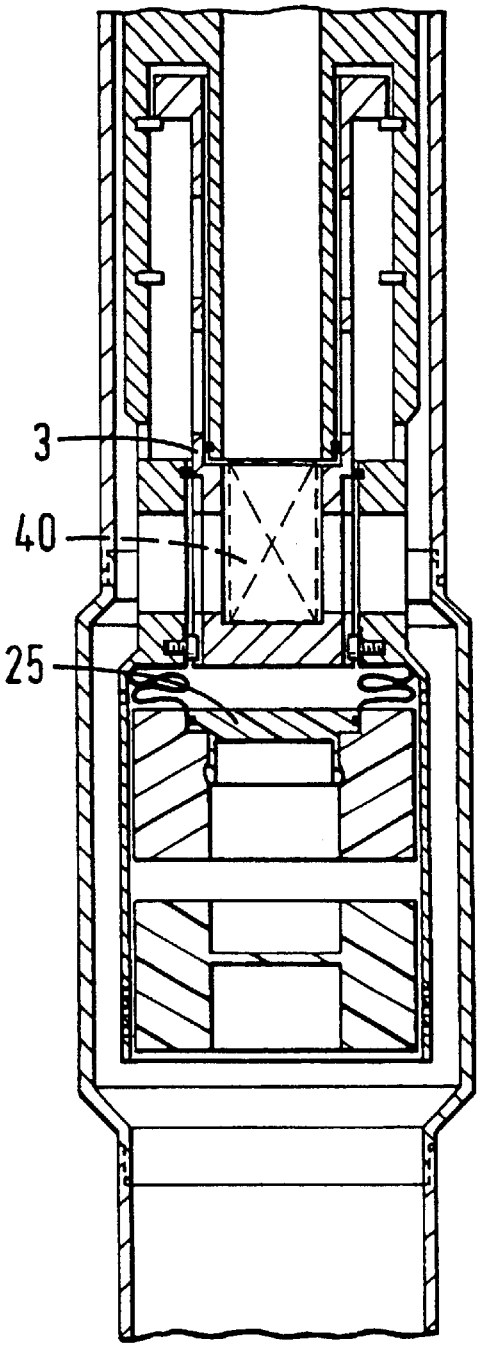
Figure 2C:
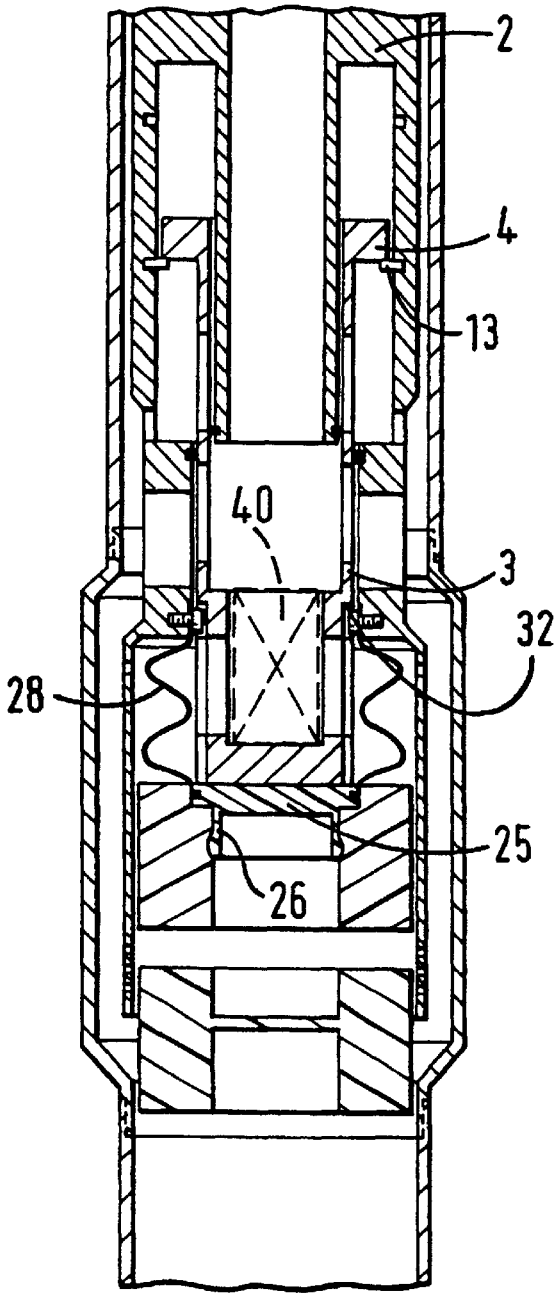
Figure 2D:
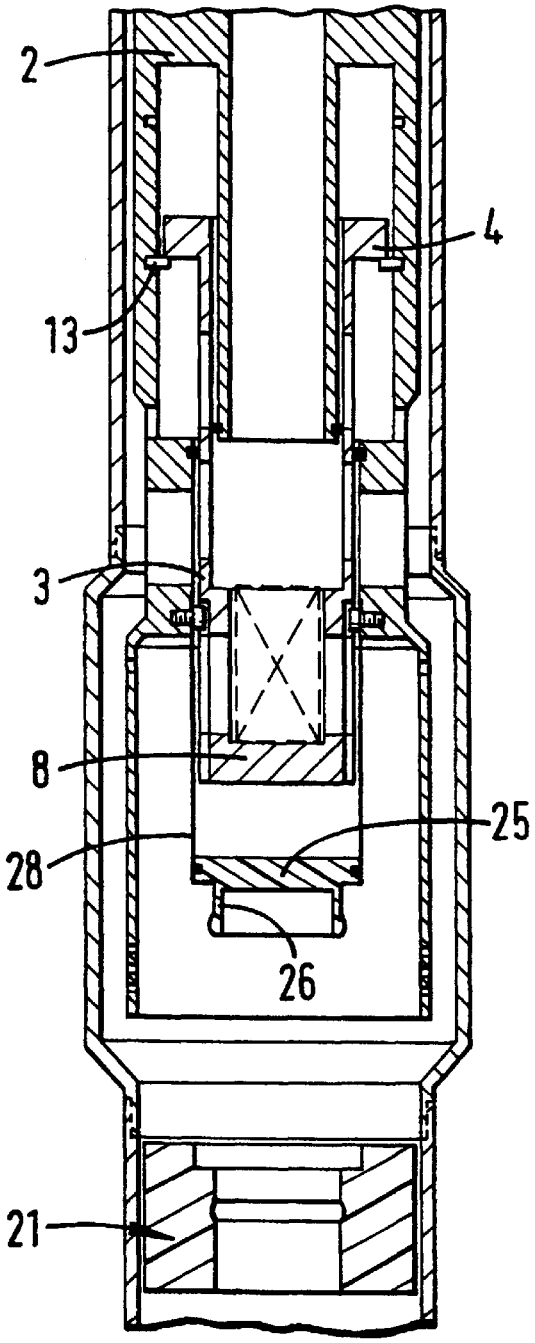

FIGS. 2*a* and 2*d* relate to abnormal operation, wherein both upper and lower plugs are inadvertently launched together.

With regard to FIGS. 2*a* and 2*b* the first two stages of operation are identical to that described above with reference to FIGS. 1*a* and 1*b*. However, after the first dart 40 is received in the displacement member 3, the displacement member moves downwardly, shearing shear pins 11 and launching the lower plug 22. However, upper plug 21 abnormally launches simultaneously. It should perhaps be added that the reasons why an upper plug and a lower plug launch simultaneously are not fully understood although the phenomena itself is well documented.

Lip 4 landing on shear pins 13 prevent further downward movement of the displacement member 3. Thus, shoulder 32 does not shear the shear bolts 29. The flexible belts 28 reach maximum extension and restrain the cap 25 from downward movement. The upper plug 21 continues downward and parts from the cap 25. Flow path 24 is now available for the cement to pass through thus enabling the operator to flush the cement from the liner.

Various modifications to the preferred embodiment are envisaged, for example the plug launching apparatus could accommodate three or more plugs. The upper shear pins, lower shear pins 13 and shear bolts 29 could be replace by shear rings or any other suitable shear devices. Similarly, the flexible belt 28 could be replaced by any suitable form of attachment means.

What is claimed is:

1. A plug for use in wellbore operations, which plug (21) comprises a body (23) having a flow path (24) therethrough and a cap (25) for blocking flow of fluid through said flow path (24), characterized in that said cap (25) is detachable from said body (23) in use.

2. A plug as claimed in claim 1, further comprising a restraining device (28) attached to said cap (25).

3. A plug as claimed in claim 2, wherein said restraining device (28) comprises a flexible belt.

4. A plug as claimed in claim 1, further comprising a sealing ring (27) to provide a substantially fluid tight seal between said cap (25) and said body (23) of said plug (21).

5. A plug as claimed in claim 1, wherein said plug comprises elastomeric material.

6. A plug as claimed in claim 1, wherein said cap (25) is attached to said body (23) by fingers (26).

7. An apparatus for launching at least two plugs, said apparatus comprising a mandrel (2), a lower plug (22) and an upper plug (21) releasably disposed with respect to said mandrel (2), wherein said upper plug (21) comprises a body (23) having a flow path (24) therethrough and a cap (25) for blocking fluid flow through said flow path (24) characterized in that said cap (25) is detachable from said body (23) in use.

8. An apparatus as claimed in claim 7, further comprising a restraining device (28) attached to said cap (25) and to said mandrel (2).

9. An apparatus as claimed in claim 8, wherein said restraining device (28) comprises a flexible belt.

10. An apparatus as claimed in claim 8, wherein said restraining device (28) is attached to said mandrel (2) via a shear pin (29).

11. An apparatus as claimed in claim 10, wherein said shear pin (29) is adapted to be sheared after completion of an operation intended to release said upper plug (21).

12. An apparatus as claimed in claim 10, wherein said operation is landing of a dart (41) intended to initiate release of said upper plug.

13. An apparatus as claimed in claim 7, further comprising a sealing ring (27) to provide a substantially fluid tight seal between said cap (25) and said body (23) of said plug (21).

14. An apparatus as claimed in claim 7, wherein said cap (25) is attached to said body (23) by fingers.

* * * * *

UNITED STATES PATENT AND TRADEMARK OFFICE

CERTIFICATE OF CORRECTION

PATENT NO. : 6,311,771 B1
DATED : November 6, 2001
INVENTOR(S) : Gudmestad et al.

It is certified that error appears in the above-identified patent and that said Letters Patent is hereby corrected as shown below:

Column 5,
Line 25, please replace "replace" with -- replaced --.

Signed and Sealed this

Ninth Day of April, 2002

*Attest:*

*Attesting Officer*

JAMES E. ROGAN
*Director of the United States Patent and Trademark Office*